US010183485B2

(12) United States Patent
Askeland et al.

(10) Patent No.: US 10,183,485 B2
(45) Date of Patent: Jan. 22, 2019

(54) METHOD OF PRINTING IN A MULTIPASS MODE AND A PRINTING APPARATUS FOR IMPLEMENTING SUCH A METHOD

(71) Applicants: HEWLETT-PACKARD DEVELOPMENT COMPANY, L.P., Houston, TX (US); Ronald Albert Askeland, Sant Cugat del Valles (ES); Alex Andrea Tallada, Sant Cugat del Valles (ES); Juan Manuel Garcia Reyero Vinas, Sant Cugat del Valles (ES)

(72) Inventors: Ronald Albert Askeland, San Diego, CA (US); Alex Andrea Tallada, Barcelona (ES); Juan Manuel Garcia Reyero Vinas, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/520,999

(22) PCT Filed: Oct. 31, 2014

(86) PCT No.: PCT/EP2014/073487
§ 371 (c)(1),
(2) Date: Apr. 21, 2017

(87) PCT Pub. No.: WO2016/066225
PCT Pub. Date: May 6, 2016

(65) Prior Publication Data
US 2017/0341380 A1 Nov. 30, 2017

(51) Int. Cl.
*B41J 2/21* (2006.01)
*B41J 2/045* (2006.01)
*B41J 11/00* (2006.01)

(52) U.S. Cl.
CPC ..... *B41J 2/04551* (2013.01); *B41J 2/04586* (2013.01); *B41J 2/2114* (2013.01);
(Continued)

(58) Field of Classification Search
CPC ..... B41J 2/211; B41J 2/2114; B41J 2/04501; B41J 11/0015
See application file for complete search history.

(56) References Cited

U.S. PATENT DOCUMENTS 6,158,835 A 12/2000 Jackson et al.
6,491,374 B1 12/2002 Bauer et al.
(Continued)

FOREIGN PATENT DOCUMENTS

CN 1635405 A 7/2005
CN 1955001 A 5/2007
(Continued)

OTHER PUBLICATIONS

Kamasak, et al. Dynamic Print Mode Control for Inkjet Printing.

*Primary Examiner* — Sharon A Polk
(74) *Attorney, Agent, or Firm* — HP Inc. Patent Department

(57) ABSTRACT

The present disclosure relates particularly but not exclusive to a method for printing in a multipass print mode using a first printhead (PT1) and a second printhead (PT2), the method including printing in a first pass a first image in a first area of a print medium using a first set (ST21) of nozzles (N5-N24) from the first printhead (PT1), printing in a second pass a coating layer over the first image using a second set (ST22) of nozzles (P4-P22) from the second printhead (PT2), and printing in a third pass a second image over the coating layer using a third set (ST23) of nozzles (N1-20) from the first printhead (PT1).

12 Claims, 10 Drawing Sheets

(52) U.S. Cl.
CPC ..... *B41J 2/2117* (2013.01); *B41J 2/2132* (2013.01); *B41J 11/0015* (2013.01); *B41J 2/2139* (2013.01)

(56) References Cited

U.S. PATENT DOCUMENTS

| | | | | |
|---|---|---|---|---|
| 6,601,935 | B2 | 8/2003 | Vega et al. | |
| 7,562,957 | B2 | 7/2009 | Mills et al. | |
| 8,899,713 | B2 * | 12/2014 | Ishimoto | B41J 2/1433 347/14 |
| 9,004,642 | B2 * | 4/2015 | Fernandez Del Rio | B41J 2/07 347/20 |
| 2003/0090537 | A1 | 5/2003 | Tanaka et al. | |
| 2006/0158473 | A1 | 7/2006 | Mills | |
| 2007/0085889 | A1 | 4/2007 | Cardells et al. | |
| 2007/0109343 | A1 * | 5/2007 | Geurts | B41J 19/145 347/19 |
| 2009/0244605 | A1 | 10/2009 | Yoshida | |
| 2009/0267982 | A1 * | 10/2009 | Horii | B41J 19/142 347/14 |
| 2010/0238211 | A1 | 9/2010 | Usada et al. | |
| 2012/0076999 | A1 | 3/2012 | Nakano et al. | |
| 2014/0313526 | A1 | 10/2014 | Davidson | |
| 2015/0314615 | A1 * | 11/2015 | Humet | B41J 2/2103 347/9 |

FOREIGN PATENT DOCUMENTS

| | | | |
|---|---|---|---|
| CN | 101164790 | A | 4/2008 |
| JP | 2004272545 | | 9/2004 |

* cited by examiner

| | S1 | S2 | S3 | S4 | S5 | S6 | S7 | S8 |
|---|---|---|---|---|---|---|---|---|
| 1 | N6 | N6 | P6 | P6 | N6 | N6 | | |
| 2 | N7 | N7 | P7 | P7 | N7 | N7 | | |
| 3 | N8 | N8 | P8 | P8 | N8 | N8 | | |
| 4 | N9 | N9 | P9 | P9 | N9 | N9 | | |
| 5 | N10 | N10 | P10 | P10 | N10 | N10 | | |
| 6 | N11 | N11 | P11 | P11 | N11 | N11 | | |
| 7 | N12 | N12 | P12 | P12 | N12 | N12 | | |
| 8 | N13 | N13 | P13 | P13 | N13 | N13 | | |
| 9 | N14 | N14 | P14 | P14 | N14 | N14 | | |
| 10 | N15 | N15 | P15 | P15 | N15 | N15 | | |
| 11 | N16 | N16 | P16 | P16 | N16 | N16 | | |
| 12 | N17 | N17 | P17 | P17 | N17 | N17 | | |
| 13 | N18 | N18 | P18 | P18 | N18 | N18 | | |
| 14 | N19 | N19 | P19 | P19 | N19 | N19 | | |
| 15 | N20 | N20 | P20 | P20 | N20 | N20 | | |
| 16 | N21 | N21 | P21 | P21 | N21 | N21 | | |
| 17 | N22 | N22 | P22 | P22 | N22 | N22 | | |
| 18 | N23 | N23 | P23 | P23 | N23 | N23 | | |
| 19 | N24 | N24 | P24 | P24 | N24 | N24 | | |
| 20 | | | | | | | N6 | N6 |
| 21 | | | | | | | N7 | N7 |
| 22 | | | | | | | N8 | N8 |
| 23 | | | | | | | N9 | N9 |
| 24 | | | | | | | N10 | N10 |
| 25 | | | | | | | N11 | N11 |
| 26 | | | | | | | N12 | N12 |
| 27 | | | | | | | N13 | N13 |
| 28 | | | | | | | N14 | N14 |
| 29 | | | | | | | N15 | N15 |
| 30 | | | | | | | N16 | N16 |
| 31 | | | | | | | N17 | N17 |
| 32 | | | | | | | N18 | N18 |
| 33 | | | | | | | N19 | N19 |
| 34 | | | | | | | N20 | N20 |
| 35 | | | | | | | N21 | N21 |
| 36 | | | | | | | N22 | N22 |
| 37 | | | | | | | N23 | N23 |
| 38 | | | | | | | N24 | N24 |

Pixels

METHOD OF PRINTING IN A MULTIPASS MODE AND A PRINTING APPARATUS FOR IMPLEMENTING SUCH A METHOD

BACKGROUND

Inkjet printers, thermal inkjet printers in particular, have come into widespread use in business and homes because of their low cost, high print quality, and colour printing capability.

In operation, drops of coloured ink are emitted onto the print medium such as paper or transparency film during a printing operation, in response to commands electronically transmitted to the printhead. These drops of ink combine on the print media to form the text and images perceived by the human eye.

Inkjet printers may use a number of different ink colours. One or more printheads may be contained in a print cartridge, which may ether contain the supply of ink for each printhead or be connected to an ink supply located off-cartridge. An inkjet printer usually can accommodate multiple cartridges. The cartridges typically are mounted side by side in a movable carriage which scans the cartridges back and forth within the printer in a forward and reward direction above the medium during printing such that the cartridges move sequentially over given locations, called pixels, arranged in a row and column format on the medium which is to be printed.

Each printhead has an arrangement of nozzles through which the ink is controllably ejected onto the print medium, and thus a certain width of the medium corresponding to the layout of the nozzles on the printhead can be printed during each scan, forming a printed swath.

The printer also has a print medium advance mechanism which moves the media relative to the printheads in a direction generally perpendicular to the movement of the carriage so that, by combining scans of the print cartridges back and forth the across the medium with the advance of the media relative to the printheads, ink can be deposited on the entire printable area of the media.

Most printers do not print all the required drops of all ink colours in all pixel locations in the swath in one single scan, or "pass", of the printheads across the medium. Rather, multiple scans are used to deposit the full amount of ink on the medium, with the medium being advanced after each pass by only a portion of the height of the printed swath. In this way, areas of the medium can be printed in more than one pass. In a printer which uses a "multipass" print mode, only a fraction of the total drops of ink needed to completely print each section of the image is laid down in each row of the printed medium by any single pass; areas left unprinted are filed in by one or more subsequent passes.

However, the known multipass print modes are not always satisfactory. It is in particular desirable to improve the printhead reliability in multipass print modes.

DETAILED DESCRIPTION

Figure 1:
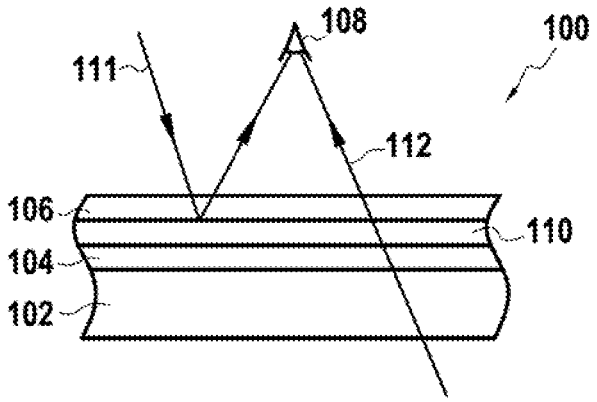
FIG. 1 shows an arrangement of printed layers obtained by carrying out a sandwich print mode according to a particular embodiment of the present disclosure.

While the present disclosure is susceptible of embodiment in many different forms, there are shown in the drawing and will be described herein in detail specific embodiments thereto with the understanding that the present disclosure is to be considered as an exemplification of the principles of the disclosure and is not intended to limit the disclosure to the specific embodiments illustrated.

Numerous details are set forth to provide an understanding of the embodiments described herein. The exemplary embodiments may be practiced without these details. In other instances, well-known methods, procedures, and components have not been described in detail to avoid obscuring the embodiments described.

For simplicity and clarity of illustration, reference numerals may be repeated among the figures to indicate corresponding or analogous elements.

FIG. 1 shows a cross-section of an arrangement 100 of printed layers produced according to a particular multipass print mode named hereafter "multichannel" print mode or "sandwich" print mode. In this example, a first image 104, a coating layer 110 and a second image 106 are successively printed over a particular area of a print medium (or substrate) 102. Both the coating layer 110 and the medium 102 are light-diffuse or translucent. The coating layer 110 can be for instance a white (or substantially white) or partially opaque layer.

First image 104 and second image 106 are typically the same image, although it is not mandatory. During daylight hours, or whenever there is sufficient ambient light 111, an observer 108 may view the second image 106 on the front side of the medium 102. In contrast, at night, or when there is insufficient ambient light, a backlight may shine light 112 through the light-diffuse medium 102, the first image 104, the coating layer 110 and the second image 106. If the first and second images 104, 106 are the same image, observer 108 sees a single, composite image.

Because both the first image 102 and the second image 106 are formed during the same printing operation, using the same printheads, the two images may be precisely aligned to one another on the print medium, thus eliminating any problem of fuzzy and distorted images.

Figure 2:
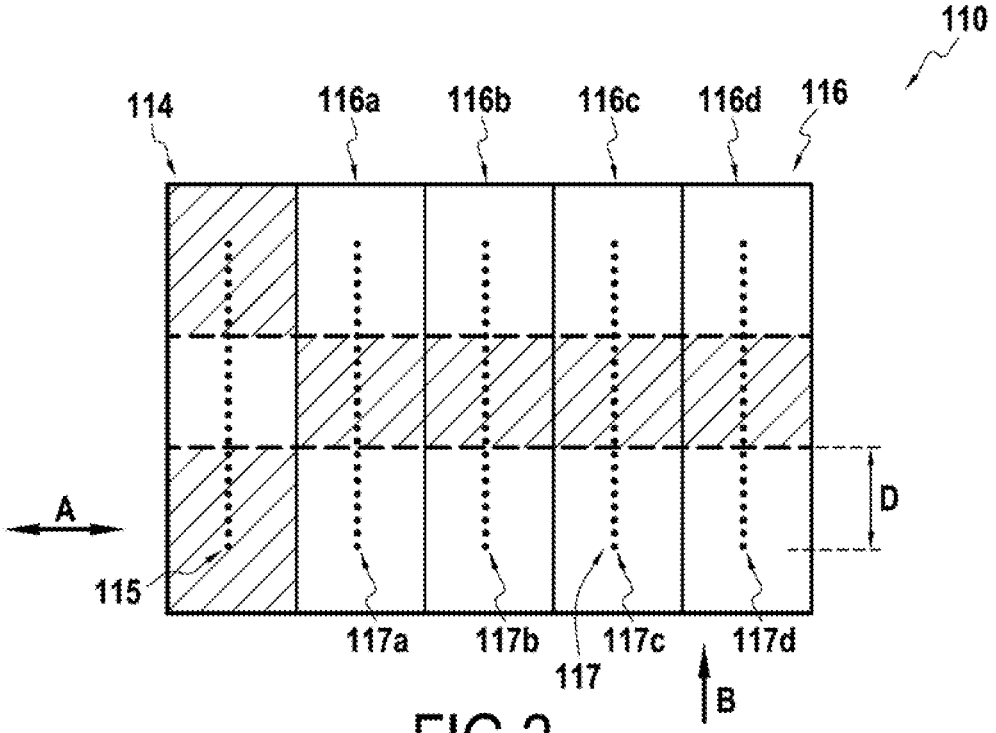
FIG. 2 shows a particular configuration of nozzle usage in printheads according to a known sandwich print mode.

A known multipass print mode which may be used to produce an arrangement of printed layers such as shown in FIG. 1 will now be briefly described in reference with FIG. 2. As schematically shown in the example of FIG. 2, a sandwich print mode is carried out using a printhead 114 and printheads 116*a*-116*d* (named collectively 116), all these printheads being aligned along a single printhead axis (direction A) that is substantially parallel to the direction of motion of the carriage of the inkjet printer. Each of the printheads 114 and 116 includes a column of nozzles (respectively 115 and 117*a*-117*d* (collectively referenced to as 117)) running along the length of the printhead. In this example, printhead 114 is configured to deposit white ink and printheads 116-116*d* are configured to deposit basic colours (such as magenta, cyan, yellow and black). Each printhead includes twenty-four nozzles.

As the carriage scans across the print medium along the direction of arrow A, ink is ejected simultaneously from the nozzles of the non-hatched regions of coloured printheads 116 and white printhead 114, but no ink is ejected from the hatched regions of these printheads. In particular, both the leading third portion and the trailing third portion of the nozzles 117 of the colour ink printheads 116 are used for printing colour images 104 and 106. In contrast, only the middle portion of the nozzles 115 of the white ink printhead 114 is used to apply white ink so as to form the coating layer 110.

Reference is made to document US 2006/0158473 which describes a particular example of a sandwich print mode. As can be understood from this document, it is required that the leading third of nozzles of the colour ink printheads are dedicated to printing the first image 104, the trailing third of nozzles of the colour ink printheads are dedicated to printing the second image 106, and the middle third of nozzles of the white printheads are dedicated to printing the white ink between the first image 104 and the second image 106.

However, the above sandwich print mode is not satisfactory for various reasons. In particular, the above conventional sandwich print mode limits the nozzles that are utilised to print ink in layers. A substantial part of the nozzles of each printhead remain inactive over the entire printing operation. The upshot of this unbalanced nozzle usage distribution across the printheads is that the printhead reliability is not optimal. Limiting the usage to only a small part of the nozzles in each printhead gives rise to an increased risk of failure of the active nozzles and thus a limited life span of the printheads. There is also a risk of reliability failure of unused nozzles due to evaporation of volatile components of the ink. Unused nozzles often get clogged due to a build-up of ink viscosity near the nozzle orifice.

The present disclosure intends among others things to address the above problems and drawbacks. The present disclosure intends in particular to provide a multipass print mode for producing a "sandwich" layer arrangement such as shown in FIG. 1 with optimal image quality and printhead reliability.

The present disclosure provides a method for printing in a multipass print mode using a first printhead and a second printhead, wherein nozzle usage is more efficiently distributed across each printhead. The method of the disclosure allows printing arrangements of printed layers, for instance of the type shown in FIG. 1. Regarding the examples of method of printing described below, not all of the steps are required in all of the embodiments.

The disclosure also provides a printing apparatus, particularly an inkjet printer, for carrying out a multipass print mode as mentioned above.

An inkjet printer 30 according to a particular example is now described with reference to FIGS. 3 and 4.

Figure 3:
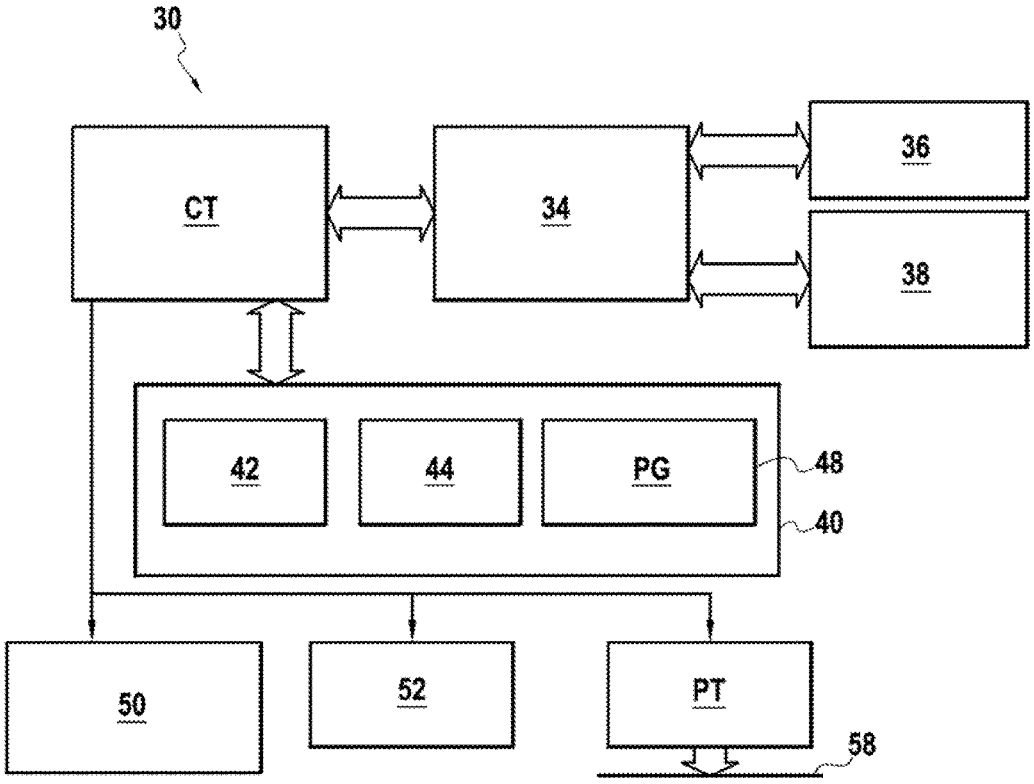
FIG. 3 is a block diagram showing in a schematic manner the arrangement of an inkjet printer according to a particular embodiment of the present disclosure.

As shown in the block diagram of FIG. 3, the inkjet printer 30 includes a controller CT (e.g. a microprocessor) that can communicate with an external terminal 36 by means of an interface unit 34, if such a terminal 36 is coupled with the printer 30.

The interface unit 34 may for instance facilitate the transferring of data and command signals to the controller CT for printing purposes. The interface unit 34 may also enable the inkjet printer 30 to be electrically coupled to an input device 38 for the purpose of downloading print image information to be printed on a print medium 58. Input device 38 can for instance be any type of peripheral device that can be coupled directly to the printer 30.

The substrate or medium 58 which is considered in the present document may be any sort of sheet-like or web-based medium, including paper, cardboard, plastic and textile.

In order to store data, the printer 30 further includes a memory unit 40. The memory unit 40 may be divided into a plurality of storage areas that facilitate printer operations.

In the present example, the memory unit 40 includes a data storage unit 42, a storage unit 44 for driver routines, and a control storage unit 48 that may store the algorithm that facilitate the control implementation of the various components of the printer 30.

The data storage unit 42 may receive image data representative of one or more images which may be printed by the inkjet printer 30 on a print medium 58.

In the present example, the control storage unit 48 stores a computer program PG according to a particular embodiment, said computer program PG including instructions for carrying out a method according to a particular embodiment. The control storage unit 40 constitutes a recording medium according to a particular embodiment, readable by the controller CT.

The computer program PG can be expressed in any programming language, and can be in the form of source code, object code, or any intermediary code between source code and object code, such that in a partially-compiled form, for instance, or in any other appropriate form.

In addition, the recording medium 48 can be any entity or device capable of storing the computer program. For example, the recording medium can comprise a storing means, such as a ROM memory (a CD-ROM or a ROM implemented in a microelectronic circuit), or a magnetic storing means such as a floppy disk or a hard disk for instance.

Moreover, the recording medium 48 can correspond to a transmittable medium, such as an electrical or an optical signal, which can be conveyed via an electric or an optic cable, or by radio or any other appropriate means. The computer program according to the invention can in particular be downloaded from the Internet or a network of the like.

In this particular example, the controller CT is operative to cooperate with the following components of the inkjet printer 30:

a medium feeding unit 50;

a carriage unit 52;

printheads PT coupled to the carriage unit 52.

Preferably, each printhead PT can be removably coupled to the carriage unit 52.

In the present case, it will be assumed that a first printhead PT1 and a second printhead PT2 (collectively referred to as PT) are coupled to the carriage unit 52.

Figure 5:
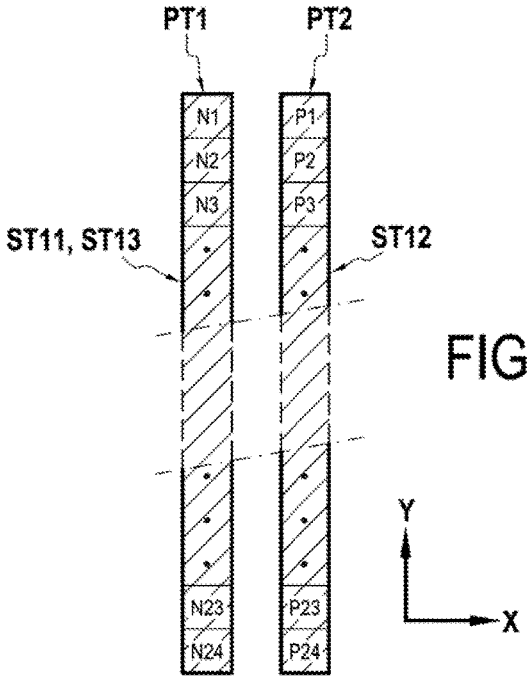
FIG. 5 shows in a schematic manner a first configuration of nozzle usage in first and second printheads according a first embodiment of the present disclosure.

As shown in FIG. 5, first printhead PT1 is provided with a column of twenty four nozzles N1-N24 and the second printhead PT2 is provided with a column of twenty four nozzles P1-P24. This however constitutes a mere example of implementation. Other arrangements of printheads and nozzles may be contemplated within the scope of the present disclosure.

The first and second printheads PT1, PT2 are disposed in a printhead array along a single printhead axis (x direction).

In the present example, the first printhead PT1 is operable to deposit colour ink by nozzles N1-N24. In the example considered hereinafter, any appropriate colour ink (magenta, cyan, yellow and/or black for instance) for the purpose of printing an image may be used in first printhead PT1.

In the present example, the second printhead PT2 is operable to deposit a specialized printing fluid by nozzles P1-P24 to form a coating layer between a first image and a second image, as explained earlier with reference to FIG. 1. For backlight imaging, the specialized printing fluid preferably is translucent to light. One such specialised printing fluid that satisfied this criterion s a white (or substantially white) ink. In the following examples, white ink will be used for depositing a coating layer.

It should be understood that a plurality of first printheads PT1 and/or a plurality of second printheads PT2 may be used in the present disclosure. For the sake of clarity, only one first printhead PT1 and one second printhead PT2 are used in the present case.

The medium feeding unit 50 (or print medium advance mechanism) is operable to move the print medium 58 along a printing-medium advance direction y. The medium feeding unit 50 may for instance include rollers, a driving motor, detection means and/or any other appropriate means (not shown) for the purpose of moving the print medium 50 along the y direction to the desired position relative to the printheads PT1, PT2, so as to allow printing by these printheads.

The controller CT is operable to control the medium feeding unit 50 so as to adjust the relative position of the print medium 58 along the printing-medium advance direction y in order to cause printing at the appropriate locations on the print medium 58.

The carriage unit 52 is operable to move along a traverse (or scan) direction x in response to commands from the controller CT.

Figure 4:
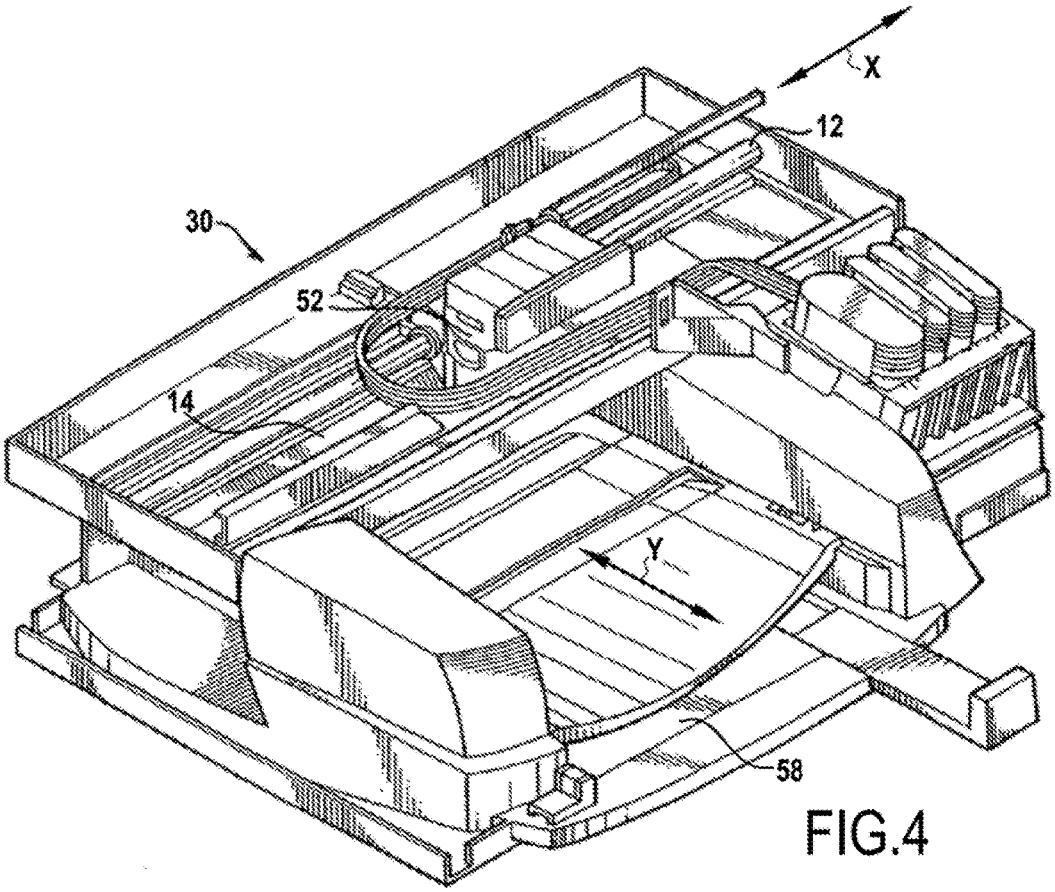
FIG. 4 is a perspective view depicting an inkjet printer according to a particular embodiment of the present disclosure.

FIG. 4 shows a particular example of implementation of the inkjet printer of FIG. 3, although many other embodiments may be contemplated.

In this particular example, the carriage unit 52 is supported by a slide rod 12 that permits the carriage unit 52 to move along the traverse direction x under the driving force of a carriage mechanism. The print medium 58 can be stopped in a print zone 14 and the scanning carriage unit 52 is scanned across the print medium 58 for printing a swath of ink thereon. After a single scan or multiples scans, the print medium 58 can be incrementally shifted using a stepper motor and feed rollers to a next position within the print zone 14 for printing a next swath of ink.

In operation, the controller CT controls movements of the carriage unit 52 and of the print medium 58, and cause ink deposition by the printheads PT1 and PT2. By combining the relative movements of the carriage unit 52 along the scan direction x with the relative movement of the print medium 58 along the medium-advance direction y, each printhead PT can deposit one or more drops of ink at each individual one of the pixel locations of the print medium 58.

A first example of a multipass print mode according to the disclosure will now be described with reference to FIGS. 5-8.

Turning back to FIG. 5, as indicated earlier, each of printheads PT1 and PT2 includes 24 nozzles N1-N24 and P1-P24 respectively. In this example, Ni and Pi are positioned in correspondence with each other in the y direction (i=1 . . . 24), although other embodiments can be contemplated within the scope of the present disclosure.

Figure 8:
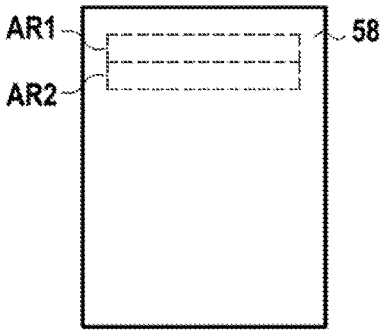
FIG. 8 shows a print medium including a first area and a second area on which printing operations are to be performed.
Figure 9:
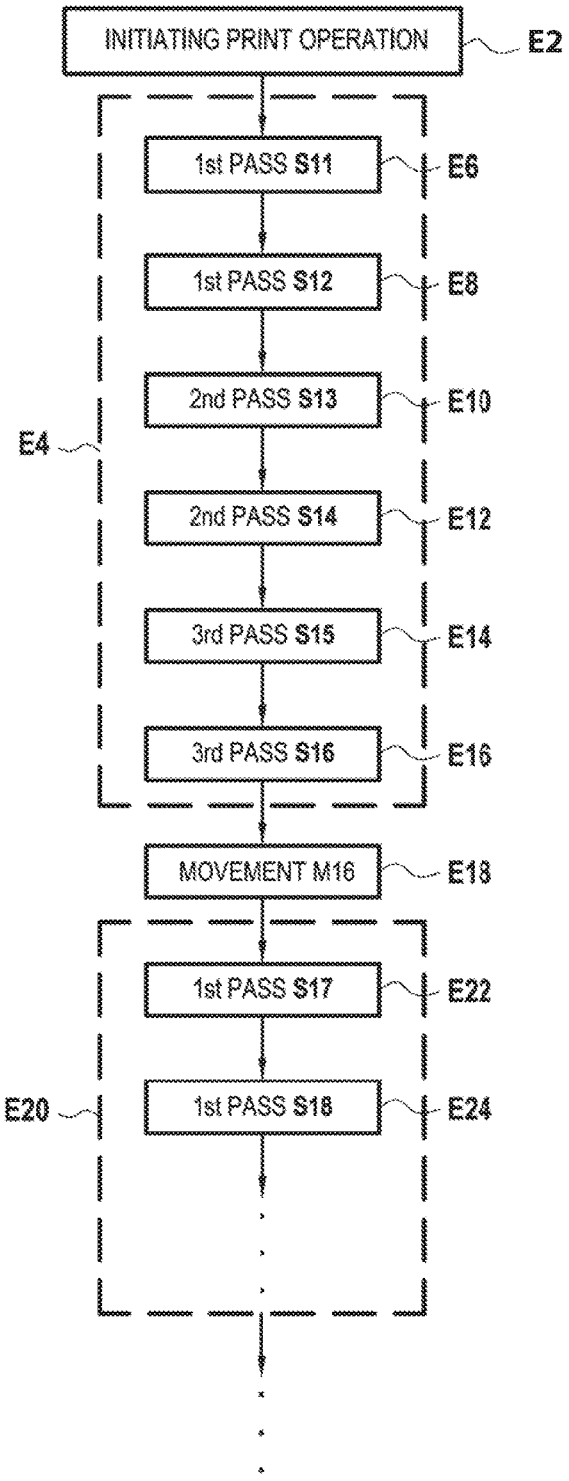
FIG. 9 is a flowchart showing steps of a method of printing according to the first embodiment of the present disclosure.

According to the present embodiment, a print sequence is performed using printheads PT1 and PT2 to cause printing in a multipass print mode on a first area AR1 of the print medium 58 (FIG. 8). This print sequence includes successively two "first" passes (or sweeps) S11 and S12, two "second" passes S13 and S14, and two "third" passes S15 and S16. Each of these passes will be described in more detail further below. It should be understood that the disclosure is not limited to this particular example. The print sequence may include at least one so-called first pass, at least one so-called second pass, and at least one so-called third pass, as explained in further detail below.

To perform the above print sequence:

- a first set ST11 of nozzles of printhead PT1 is operable, for each first pass, to print colour ink in the first area AR1 of the print medium 58;
- a second set ST12 of nozzles of printhead PT2 is operable, for each second pass, to print white ink in the first area AR1 of the print medium 58; and
- a third set ST13 of nozzles of printhead PT1 is operable, for each third pass, to print colour ink in the first area AR1 of the print medium 58.

The first and second printheads PT1, PT2 are configured to move along the single printhead axis (x direction) at each first, second and third pass.

In the present example, the first and third sets ST11, ST13 represent the totality of the nozzles operable in the first printhead PT1 to print an image, and the second set ST12 represents the totality of the nozzles operable in the second printhead PT2 to print a coating layer (with white ink).

Accordingly, the first and third sets ST11, ST13 are identical in the present case, although this is not obligatory. In other terms, each nozzle N1-N24 of first printhead PT1 are common to the first and third sets ST11, ST13 of nozzles in the present example. In addition, all these common nozzles N1-N24 and all the nozzles P1-P24 of the second printhead PT2 are configured to be positioned at a same position (e.g. first area AR1) on the print medium 58 in each first, second and third pass of a given print sequence, as explained in more detail further below.

In a variant, at least one of first and second sets ST11, ST12 represent only part of all the nozzles available in the first printhead PT1. Likewise, the second set ST12 may only represent part of all the nozzles available in the second printhead PT2.

In a particular embodiment, each of the first and third sets of nozzles ST11, ST13 represents at least 50% of the total number of nozzles operable in the first printhead PT1 and the second set ST12 represents at least 50% of the total number of nozzles operable in the second printhead PT2.

A sandwich print mode using the printhead configuration shown in FIG. 5 will now be described with reference to FIGS. 6-9. The nozzles of printheads PT1, PT2 which are active during a particular pass are represented in a hatched region while the nozzles which remain inactive during a particular pass are represented in a non-hatched region.

A printing operation is initiated in step E2, for instance upon reception by printer 30 of image data to be printed on the print medium 58. It is assumed that the print medium is brought into position by the medium feed unit 50 under control of controller CT, so that the first and second printheads PT1, PT2 can deposit ink in the first area AR1 of the print medium 58.

In the following steps, the controller CT controls the printheads PT1, PT2, the medium feed unit 50 and the carriage unit 52 to cause printing at appropriate timing on appropriate pixel locations on the print medium 58.

Figure 6:
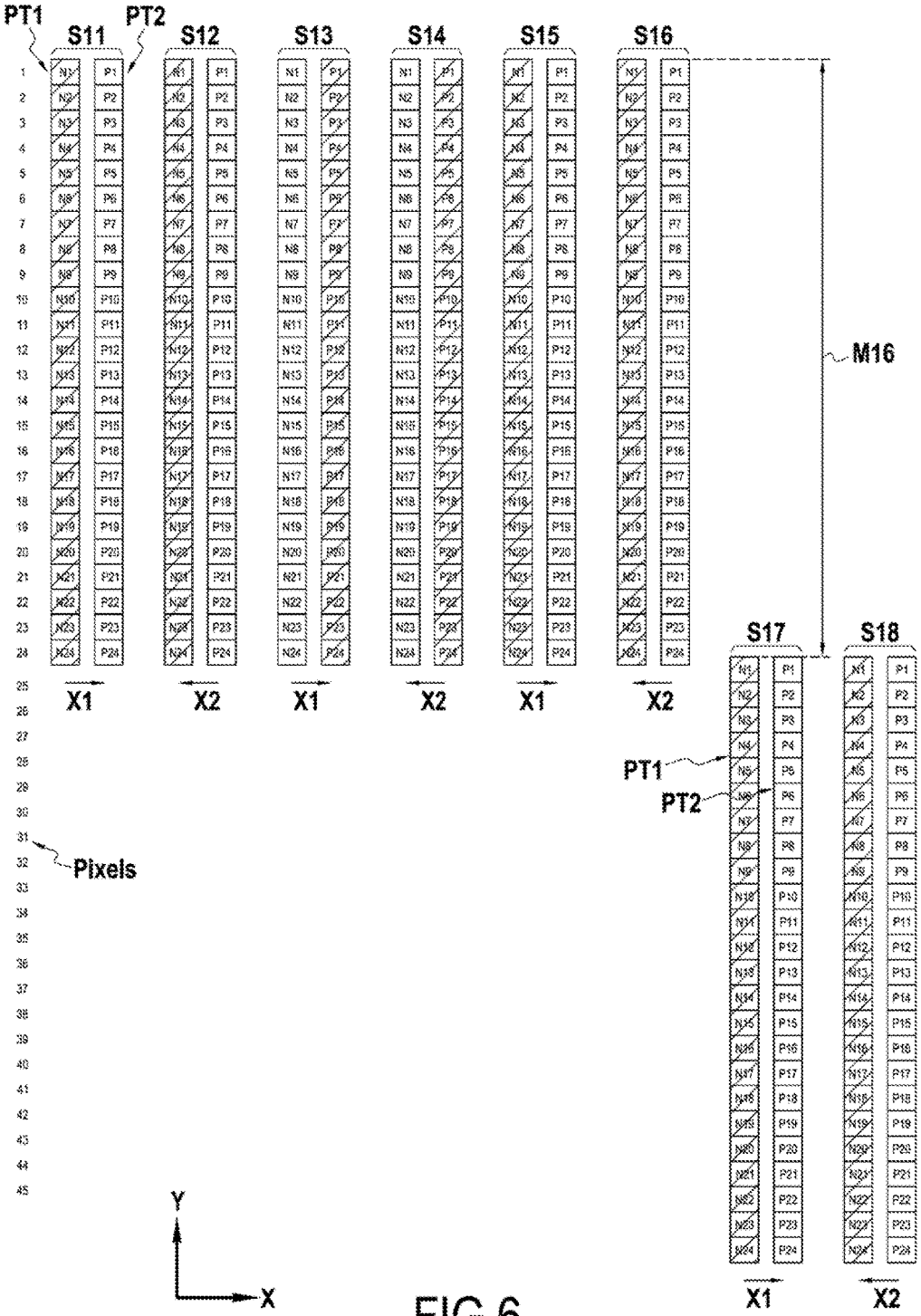
FIGS. 6 and 7 show in a schematic manner a method of printing in a multipass print mode according to the first embodiment of the present disclosure.

In a first print sequence E4, the first set ST11 of nozzles in printhead PT1 deposits (E6) colour ink in the first area AR1 of the print medium at a pass S11 so as to form a first image. The first set ST11 of nozzles then deposits (E8) a second swath of colour ink in the first area AR1 in another pass S12 so as to complete the first image. Passes S11 and S12 are "first" passes which may be performed in opposite direction X1 and X2 along the x axis (as shown in FIG. 6) or in the same direction along the x axis. The same apples to the other passes hi FIG. 6.

During first passes S11 and S12, the entire set ST11 is an active zone, i.e. a zone of nozzles which are operable to deposit ink in the first area AR1.

In addition, the second set ST12 of nozzles in printhead PT2 (and, more generally, all the nozzles of the second printhead PT2 in this case) remain inactive in first passes S11 and S12. No ink is deposited from any of nozzles P1-P24 of second printhead PT2 during passes S11 and S12.

Next, the second set ST12 of nozzles P1-P24 in printhead PT2 deposits (E10) white ink in the first area AR1 of the print medium during at second pass S13 to form a coating layer (of white ink in the present case) over the first image. The second set ST12 of nozzles then deposits (E12) a second swath of white ink in the first area AR1 in another second pass S14 to complete the coating layer.

During second passes S13 and S14, the entire set ST12 is an active zone, i.e. a zone of nozzles which are operable to deposit ink in the first area AR1.

In addition, the first and third sets ST11, ST13 of nozzles in printhead PT1 (and, more generally, all the nozzles of the first printhead PT1 in this case) remain inactive in second passes S13 and S14. No ink is deposited from any of nozzles N1-N24 of first printhead PT1 during second passes S13 and S14.

The third set ST13 of nozzles N1-N24 in printhead PT1 then deposits (E14) colour ink in the first area AR1 of the print medium during a third pass S15 to form a second image over the coating layer. The third set ST13 of nozzles then deposits (E16) a second swath of colour ink in the first area AR1 in another third pass S16 to complete the second image.

During third passes S15 and S16, the entire set ST13 is an active zone, i.e. a zone of nozzles which are operable to deposit ink in the first area AR1.

In addition, the second set ST12 of nozzles in printhead PT2 (and, more generally, all the nozzles of the second printhead PT2 in this case) remain inactive in third passes S15 and S16. No ink is deposited from any of nozzles P1-P24 of second printhead PT2 during passes S15 and S16.

The controller CT control the medium feed unit 50 to cause a movement M16 (E18) of the print medium 58 relative to the printheads PT1 and PT2 along the y direction so that the first, second and third sets ST11, ST12, ST13 of nozzles can deposit ink in a second area AR2 of the print medium 58 adjacent to the first area AR1 (FIG. 8).

In the present example, the movement M16 corresponds to a distance along the y direction equivalent to the entire length of the first, second and third sets ST11, ST12, ST13 of nozzles.

Once the printheads PT1, PT2 are in position above the print medium 58, a second print sequence E20 analogous to the first print sequence E4 is performed to print, in the second area AR2 of the print medium 58, another arrangement of printed layers of the type shown in FIG. 1.

More specifically, the first set ST11 of nozzles in printhead PT1 deposits (E22) colour ink in the second area AR2 of the print medium at a first pass S17 so as to form a first image (which may be identical or different from the first image formed in the first print sequence E32). The first set ST11 of nozzles then deposits (E24) a second swath of colour ink in the second area AR2 in another first pass S18 to complete the first image.

During first passes S17 and S18, the entire set ST11 is an active zone, i.e. a zone of nozzles which are operable to deposit ink in the second area AR2.

In addition, the second set ST12 of nozzles in printhead PT2 (and, more generally, all the nozzles of the second printhead PT2 in this case) remain inactive in first passes S17 and S18. No ink is deposited from any of nozzles P1-P24 of second printhead PT2 during passes S17 and S18.

The remainder of second print sequence E20 proceeds in the same manner as first print sequence E4, and will therefore not be described for the sake of conciseness.

The process described above is repeated until the printing operation is over.

As can be understood, the first and second Images and the coating layer are printed sequentially and independently of one another. In other words, the printed images and the coating layer are not simultaneously deposited on the same portion of the print medium so as to avoid the respective printing fluids to mix with each other and degrade the image quality during the printing operation.

Figure 7:
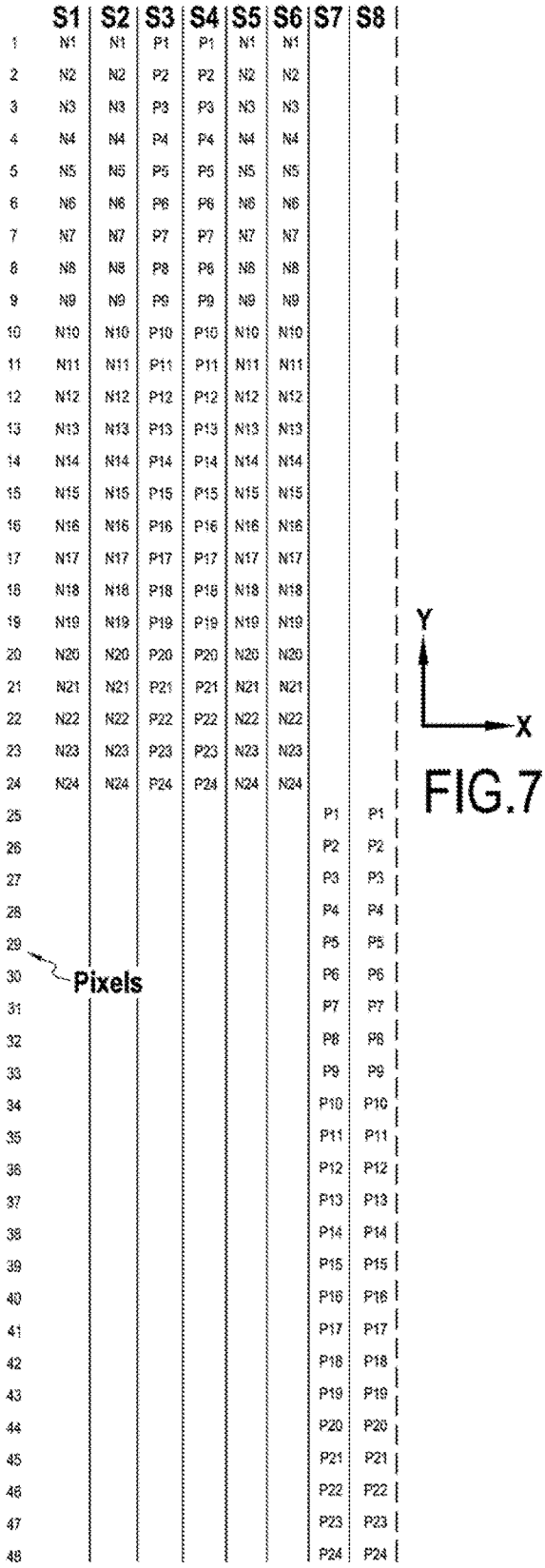

FIG. 7 shows in a different schematic manner the nozzle usage distribution in the printheads PT1, PT2 in the exemplary printing operation of FIG. 6.

As can be understood, according to the present example, the print medium 58 is not advanced uniformly relative to the printheads since a substantial movement along the y direction is only performed between each print sequence (e.g. movement M16 in E18 which is performed between print sequences E4 and E20).

Figure 10:
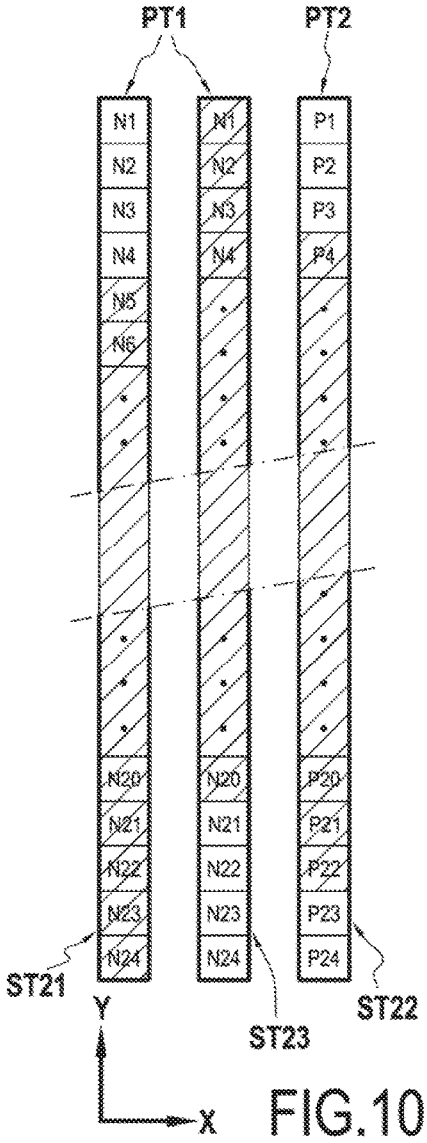
FIG. 10 shows in a schematic manner a second configuration of nozzle usage in first and second printheads according a second embodiment of the present disclosure.

A second embodiment is now described with reference to FIGS. 10-13. As shown in FIG. 10, the second embodiment differs from the embodiment of FIG. 5 in that an error-hiding mechanism is performed such that not all the nozzles of the first, second and third sets of nozzles in printheads PT1, PT2 are active in each pass.

More specifically, in the present example, the first, second and third sets of nozzles are configured as follows:

- the first set ST21 of nozzles, used for each first pass, includes only nozzles N5-N24 of first printhead PT1;
- the second set ST22 of nozzles, used for each second pass, includes only nozzles P4-P22 of second printhead PT2; and
- the third set ST23 of nozzles, used for each third pass, includes nozzles N1-N20 of first printhead PT1.

As can be seen, the first and third sets ST21, ST23 share common nozzles N5-N20. In the present example, nozzles P5-P20 of second printhead PT2 are at the same position as common nozzles N5-N20 on the print medium 58 in each first, second and third pass of a same print sequence.

As explained in further detail below, not all the nozzles in each set ST21, ST22, ST23 are used in each pass. Movements along the y direction of the print medium 58 relative to printheads PT1, PT2 are caused by the controller CT at different timings in the print sequence to implement an error-hiding mechanism. As a result, the active zone is shifted at appropriate times within the first and second sets of nozzles.

This error-hiding mechanism aims at avoiding poor ink deposition at certain pixel locations due to some failing nozzles in the first and second printheads PT1, PT2 by shifting the print medium 58 relative to the printheads PT1, PT2 along the y direction so as to use different nozzles for ink deposition at a same pixel location on the print medium 58.

When implemented, the error hiding mechanism allows significantly improving the image quality of the resultant arrangement of printed layers according to the present disclosure.

A sandwich print mode using the printhead configuration shown in FIG. 10 will now be described with reference to FIGS. 8 and 11-13. The nozzles of printheads PT1, PT2 which are active during a particular pass are represented in a hatched region while the nozzles which remain inactive during a particular pass are represented in a non-hatched region.

A printing operation is initiated in step E30, for instance upon reception by printer 30 of image data to be printed on the print medium 58. It is assumed that the print medium 58 is brought into position by the medium feed unit 50 under control of controller CT, so that the first and second printheads PT1, PT2 can deposit ink in the first area AR1 of the print medium 58 (FIG. 8).

In the following example, the controller CT controls the printheads PT1, PT2, the medium feed unit 50 and the carriage unit 52 to cause printing at appropriate timings on appropriate pixel locations on the print medium 58.

In a first print sequence E32, nozzles N6-N24 of the first set ST21 in printhead PT1 are used to deposit (E34) colour ink in the first area AR1 of the print medium at a pass S21 so as to form a first image. As can be understood, in first pass S21, the active zone Z21 in printhead PT1 only includes nozzles N6-N24 in printhead PT1. Only part of the first set ST21 is used since nozzle N5 (and nozzles N1-N4) remain inactive.

The print medium 58 is then moved (E36) relative to the printheads PT1, PT2 along the y direction by a movement M21. Movement M21 is an error hiding movement which aims at compensating for possible partial or total failure of one of nozzles N6-N24 during the first pass S21. For this purpose, the use of the nozzles in the first set ST21 of nozzles in printhead PT1 is reallocated so as to cause the first set ST21 of nozzles to keep printing the first image in the first area AR1 of the print medium 58.

In the present example, each error hiding movement is a movement along the y direction of a distance equivalent to one nozzle of printheads PT1, PT2. The disclosure is however not limited to this particular example.

Nozzles N5-N23 of the first set ST21 of nozzles then deposit (E38) a second swath of colour ink in the first area AR1 in another pass S22 to complete the first image. In first pass S22, the active zone only includes nozzles N5-N23 while nozzle N24 of the first set ST21 of nozzles remain inactive (nozzles N1-N4 also remain inactive in pass S22).

Figure 11:
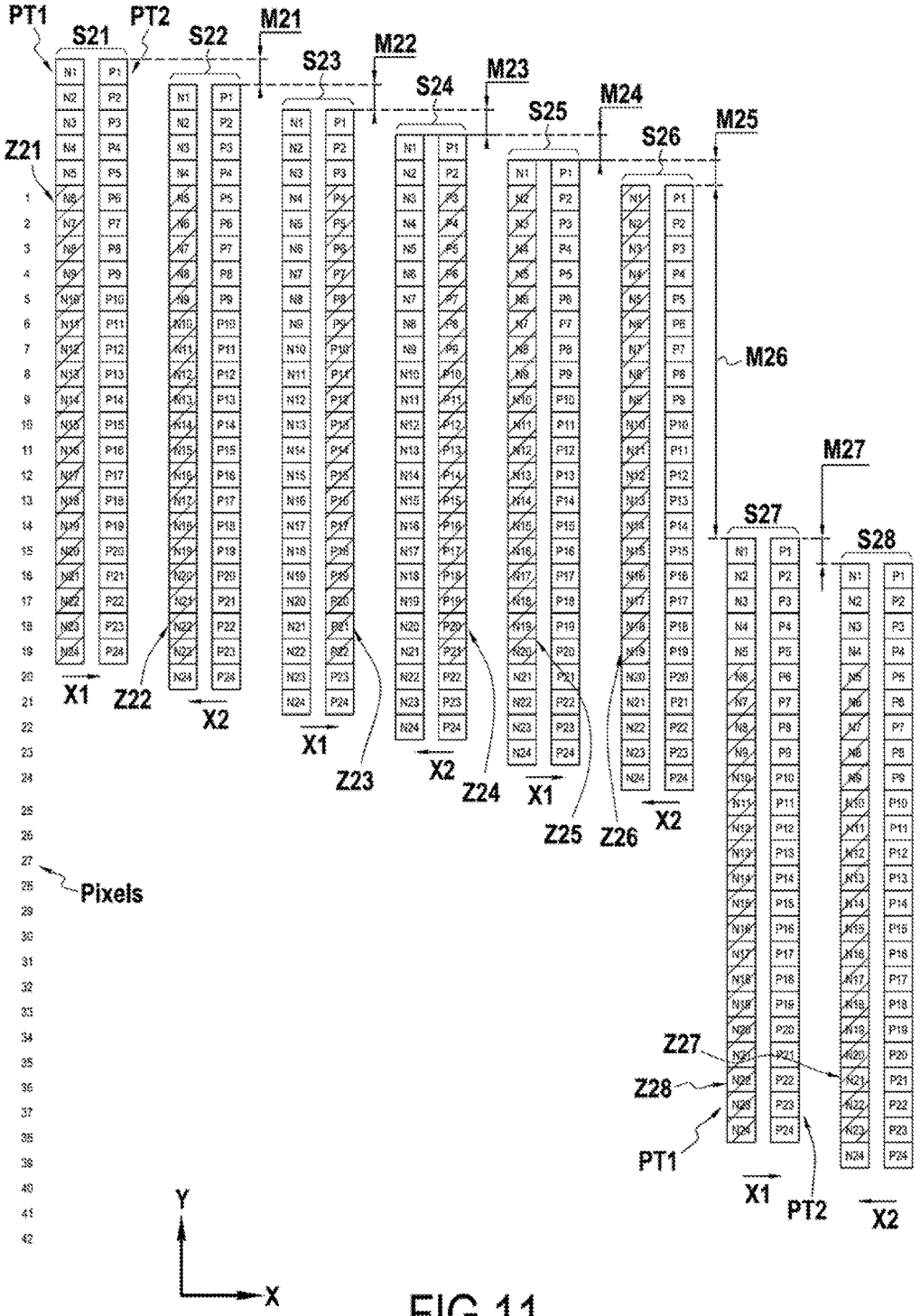
FIGS. 11 and 12 show in a schematic manner a method of printing in a multipass print mode according to the second embodiment of the present disclosure.

Passes S21 and S22 are first passes which may be performed in opposite direction X1 and X2 along the x axis (as shown in FIG. 11) or in the same direction along the x axis. The same apples to the other passes in FIG. 11.

During first passes S21 and S22, the second set ST22 of nozzles in printhead PT2 (and, more generally, al the nozzles of the second printhead PT2 in this case) remain inactive. No ink is deposited from any of nozzles P1-P24 of second printhead PT2 during first passes S21 and S22.

Following a movement M22 (E40) along the y direction, nozzles P4-P22 of the second set ST22 in printhead PT2 are used to deposit (E42) white ink in the first area AR1 of the print medium at second pass S23 so as to form a coating layer over the first image. In a variant, no movement M22 is performed prior to second pass S23, as will be explained further below.

An error-hiding movement M23 along the y direction is then performed (E44) and the use of nozzles in the second set ST22 is reallocated so as to cause the second set ST22 of nozzles to keep printing white ink in the first area AR1 of the print medium 58.

The active zone in the second set ST22, which now includes only nozzles P3-P21, performs a second pass S24 during which white ink is deposited (E46) in the first area AR1 of the print medium 58 so as to complete the coating layer.

The subsequent movements of the print medium 58 relative to printheads PT1, PT2 (M24 in E48, and M25 in E52) and the subsequent ink depositions (E50 and E54) are performed in an analogous manner and will therefore not be described for the sake of conciseness.

Following the last of the third passes (E54), the controller CT controls the medium feed unit 50 to cause a movement M26 (E56) of the print medium 58 relative to the printheads PT1 and PT2 along the y direction so that the first, second and third sets ST21, ST22, ST23 of nozzles are in position to deposit ink in the second area AR2 of the print medium 58 adjacent to the first area AR1 (FIG. 8).

In the present example, the movement M26 corresponds to a distance along the y direction equivalent to the total length of the first, second and third sets ST21, ST22, ST23 (i.e. a length equivalent to 20 nozzles).

Once the printheads PT1, PT2 are in position above the print medium 58, a second print sequence E58 analogous to the first print sequence E32 is performed to print, in the second area AR2 of the print medium 58, another arrangement of printed layers of the type shown in FIG. 1.

More specifically, nozzles N6-N24 of the first set ST21 of nozzles in printhead PT1 are used to deposit (E60) colour ink in the second area AR2 of the print medium at a pass S27 so as to form a new first image. Following an error-hiding movement M27 (E62) along the y direction, and appropriate reallocation of nozzle usage within the first set ST21 of nozzles, nozzles N5-N23 deposit (E64) a second swath of colour ink in the second area AR2 of the print medium 58 so as to complete the new first image.

The remainder of second print sequence E58 proceeds in the same manner as first print sequence E32 and will therefore not be described for the sake of conciseness.

Figure 12:
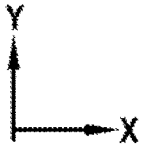
Figure 13:
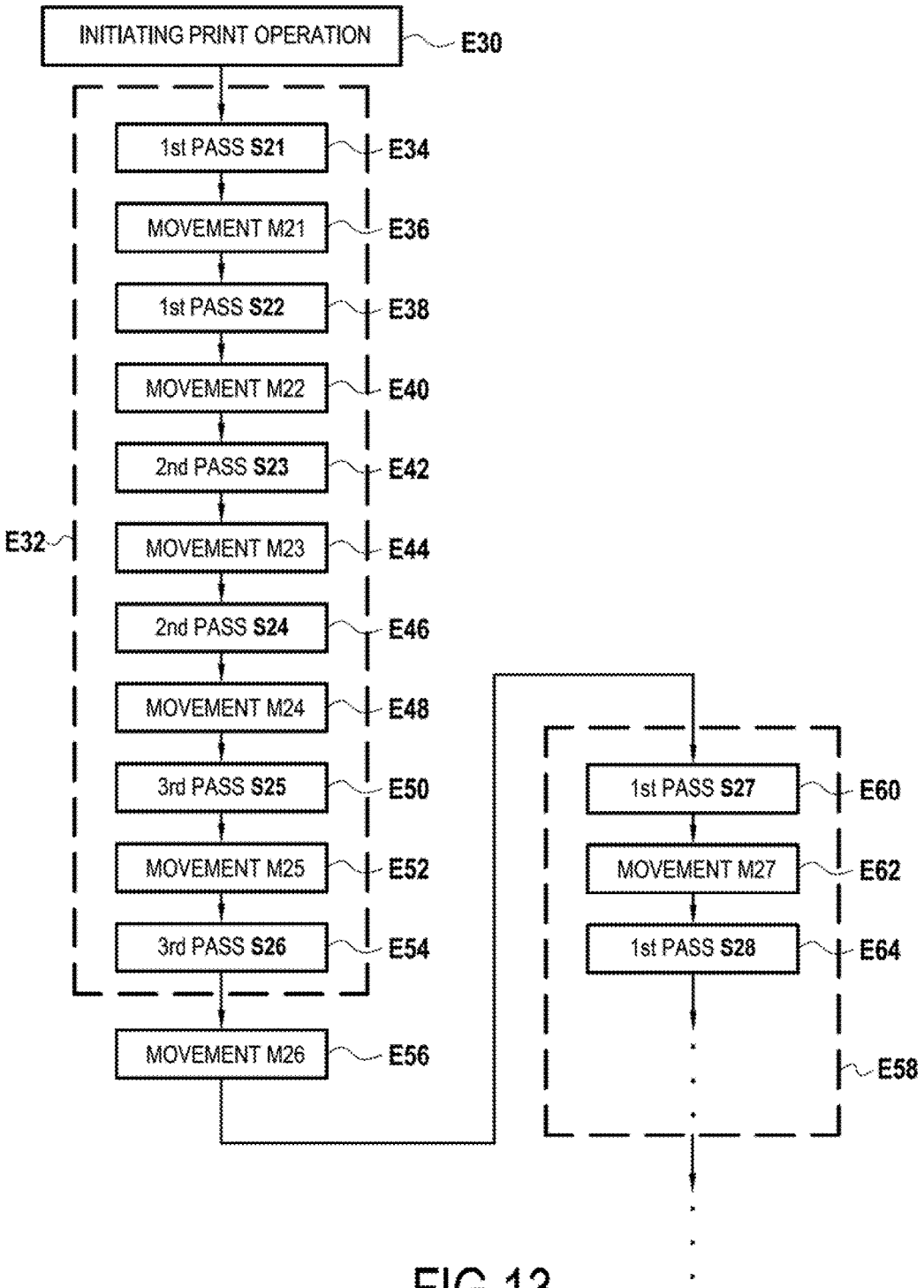
FIG. 13 is a flowchart showing steps of a method of printing according to the second embodiment of the present disclosure.

FIG. 12 shows in a different schematic manner the nozzle usage distribution in the printheads PT1, PT2 in the exemplary printing operation of FIG. 11.

As can be understood, according to the example of FIGS. 10-13, the print medium 58 is not advanced uniformly relative to the printheads. Namely, a movement of a same distance along the y direction is performed between each pass in the print sequence (e.g. movements M22 to M25)

while a movement of a different distance is performed along the y direction between each print sequence (e.g. movement M26).

In the present example, it should be noted that the movements M22 (E40) and M24 (E48) along the y direction may not be performed in print sequence E32. In a particular example, an error-hiding movement of the print medium 58 relative to the printheads is performed between each two successive first passes (e.g. between passes S21 and S22), between each two successive second passes (e.g. between passes S23 and S24), and between each two successive third passes (e.g. between passes S25 and S26).

In a variant of the second embodiment depicted in FIGS. 10-13, each print sequence includes at least two first passes, two second passes and two third passes. In this variant, the print sequence includes:

- at least one inactive pass between the last of the first passes (performed by the first set of nozzles) and the first of the second passes (performed by the second set of nozzles), and
- at least one inactive pass between the last of the second passes (performed by the second set of nozzles) and the first of the third passes (performed by the third set of nozzles).

In this variant, the first, second and third sets of nozzles remain inactive (i.e. do not print) during each inactive pass.

The number of inactive passes can be advantageously adapted to allow sufficient time to last between for instance first pass S22 and second pass S23 to allow drying of the first image on the print medium 58.

The present method of printing and the printer of the present apparatus are advantageous in that it allows implementation of a sandwich print mode in an efficient manner. Thanks to the present method, an arrangement of printed layers of the type for instance shown in FIG. 1 can be obtained. The present disclosure may however be used to produce arrangement of printed layers other than the one described earlier in reference with FIG. 1.

In a particular example, each first, second and third pass s bidirectional such that two successive pass are performed in opposite directions along the x axis, other embodiments being possible in the present disclosure.

The present method enables utilizing a substantial part of the nozzles of each printhead in the process of printing the different ink layers. In a particular embodiment, each of the first and third sets of nozzles represent at least 50% of the total number of nozzles operable in the first printhead, and the second set represents at least 50% of the total number of nozzles operable in the second printhead.

Preferably, at least ⅔ (preferably at least 75%) of the nozzles available on each printhead are used to perform the different passes of the present method of printing. In a particular example, 100% of the nozzles are used, as shown for instance in FIG. 5.

The present method allows printing in a sandwich print mode using more nozzles of the printhead than in the known sandwich print mode, thereby evening out the printing bad and improving printhead reliability. This approach can advantageously reduce the number of drops printed by a given nozzle.

In other words, effective distribution of nozzle usage across the printheads can be achieved by carrying out the present method. Efficient printing can be achieved with a simple construction of the printheads in the printer.

The present method also significantly reduces the risk of reliability failure of unused nozzles due to evaporation of volatile components of the ink. As explained earlier, unused nozzles often get clogged due to a build-up of ink viscosity near the nozzle orifice. The present method can maintain nozzle heath by having nozzles spitting waste ink, thereby avoiding that nozzles become blocked.

Figure 14:
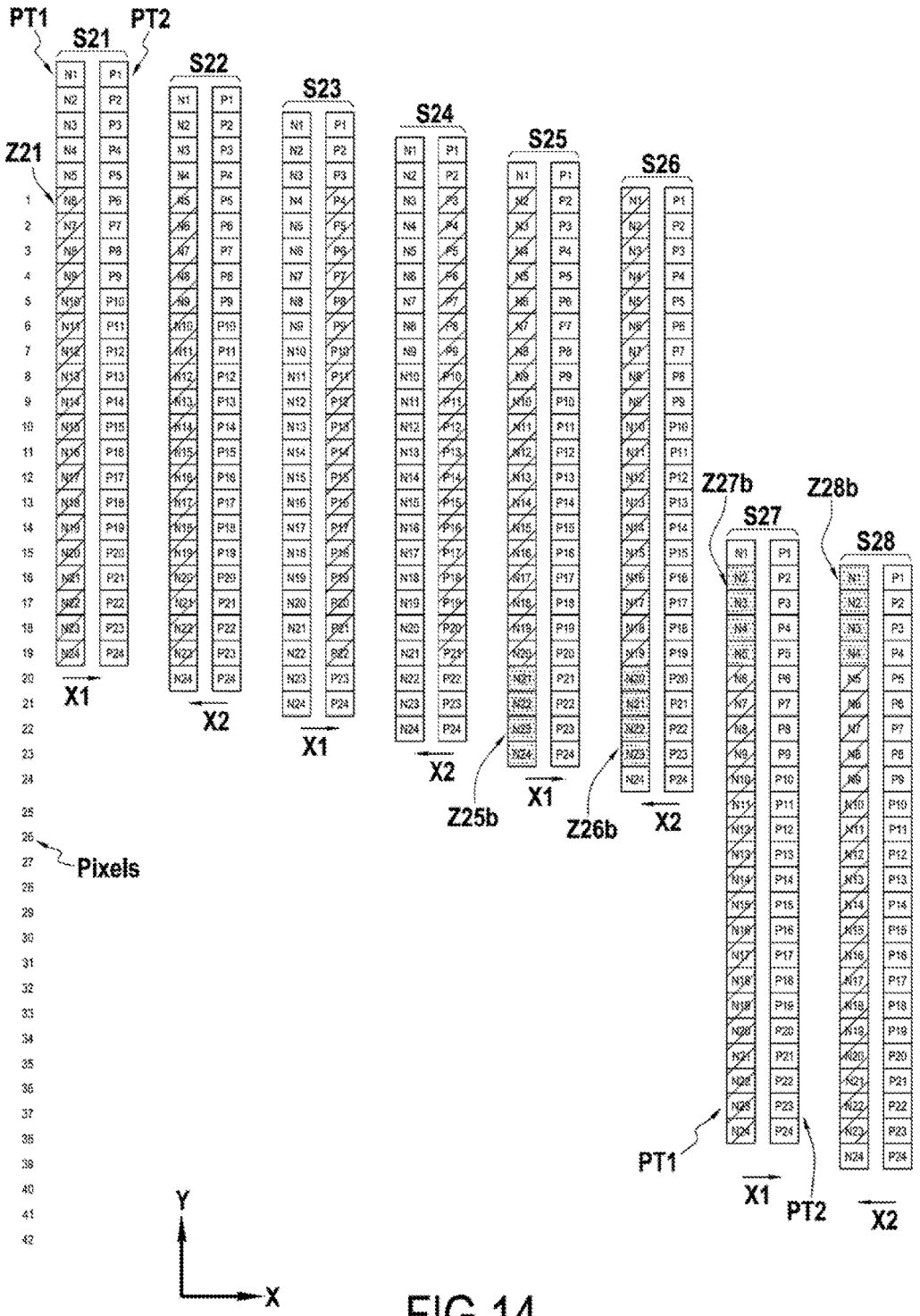
FIG. 14 shows in a schematic manner a method of printing according to a variant of the second embodiment of the present disclosure.

FIG. 14 shows a variant of the second embodiment depicted in FIGS. 10-13. This variant only differs from the embodiment of FIGS. 10-13 in that, in at least one third pass, in addition to the printing by some nozzles of the third set ST23 in the first area AR1 of the print medium 58, at least one nozzle of the first printhead PT1 is used to print part of a third image in part of the second area AR2 of the print medium adjacent to the first area AR1.

In the present example, in the third passes S25 and S26, some nozzles of the first printhead PT1 are used to deposit colour ink in the second area AR2 of the print medium 58. More specifically, in third pass S25, an additional active zone Z25*b* including nozzles P21-P24 of printhead PT1 prints part of a third image on the area AR2 of the print medium 58. Likewise, in the third pass S26, an additional active zone Z26*b* including nozzles P20-23 is used to deposit ink in the second area AR2 of the print medium 58.

The variant of FIG. 14 also differs from the embodiment of FIGS. 10-13 in that, in at least one first pass of a subsequent print sequence (print sequence E58 for instance), at least one nozzle of the first printhead PT1 is used to print part of the second image on part of the first area AR1 of the print medium 58.

In the present example, in the first passes S27 and S28, some nozzles of the first printhead PT1 are used to deposit ink in the first area AR1 of the print medium 58. More specifically, in first pass S27, an additional active zone Z27*b* including nozzles P21-P24 of printhead PT1 is used to deposit ink in the area AR2 of the print medium 58. Likewise, an additional active zone Z28*b* including nozzles P1-P4 of printhead PT1 is used to deposit ink in the first area AR1 of the print medium 58.

The above variant allows distributing usage even more across the nozzles of the printheads.

As already explained, the present disclosure is not limited to the examples described above and should be understood as encompassing various alternatives and adaptations that the skilled person would contemplate within the scope of the present disclosure. In particular, it should be understood that, the number of printheads and of nozzles therein, the printing fluids used, the composition of each set of nozzles in the printheads and the size of each active zone (when the error-hiding mechanism is implemented) can be adapted as appropriate by the person skied in the art.

The invention claimed is:

1. A method comprising:

printing in at least one first pass a first image in a first area of a print medium using a first set of nozzles from a first printhead while a second printhead remains inactive in the first area of the print medium, wherein the first and second printheads are disposed in a printhead array along a single printhead axis;

printing in at least one second pass a coating layer over the first image in the first area of the print medium using a second set of nozzles from the second printhead while the first printhead remains inactive in the first area of the print medium; and printing in at least one third pass a second image over the coating layer in the first area of the print medium using a third set of nozzles from the first printhead while the second printhead remains inactive in the first area of the print medium;

wherein at least one common nozzle to the first and third sets in the first printhead and at least one nozzle of the second set in the second printhead are at a same position on the print medium in each of the first, second and third passes; and wherein at least one of the first pass, the second pass, or the third pass, comprises two successive passes, the print sequence comprising an error-hiding movement of the print medium relative to the printheads between the two successive passes, and wherein in at least one first pass of a subsequent print sequence, at least one nozzle of the first printhead prints part of the second image on the first area of the print medium.

2. The method of claim 1, wherein the first printhead and the second printhead move along the single printhead axis at each first, second and third pass.

3. The method of claim 1, wherein the first and third sets of nozzles represent each at least 50% of a total number of nozzles operable in the first printhead to print an image.

4. The method of claim 1, wherein the second set of nozzles represents at least 50% of a total number of nozzles operable in the second printhead to print a coating layer.

5. The method of claim 1, comprising moving the print medium by a determined distance relative to the printheads once the print sequence is completed in the first area of the print medium so as to initiate a subsequent print sequence on a second area of the print medium adjacent to the first area.

6. The method of claim 5, wherein the determined distance comprises a different distance than at least a second distance of a movement between at least two additional print sequences.

7. The method of claim 1, wherein the print sequence includes:

at least two first passes, two second passes and two third passes, performing the error-hiding movement of the print medium relative to the printheads between each two successive first passes, each two successive second passes, and each two successive third passes in the print sequence, and for each of the error-hiding movement, reallocating the use of the nozzles in respectively the first set, the second set and the third set of nozzles so as to cause the first, second and third sets to print respectively the first image, the coating layer, and the second image in the first area of the print medium in each respective pass.

8. The method of claim 1, wherein, for each of the first, second and third passes, the first and third sets of nozzles include all the nozzles operable on the first printhead, and the second set of nozzles includes all the nozzles operable on the second printhead.

9. The method claim 1, wherein the print sequence includes at least two first passes, two second passes and two third passes, wherein the method includes:

at least one inactive pass between the last of the first passes and the first of the second passes, and at least one inactive pass between the last of the second passes and the first of the third passes, wherein the first, second and third sets of nozzles remain inactive during each inactive pass.

10. The method claim 1, wherein, in at least one third pass, at least one nozzle of the first printhead prints part of a third image on a second area of the print medium adjacent to the first area.

11. A method comprising:

printing in a first pass a first image on a print medium using a first set of nozzles from a first printhead;

printing in a second pass a coating layer over the first image a second set of nozzles from a second printhead, wherein the first printhead and the second printhead are disposed in a printhead array along a single printhead axis; and printing in a third pass a second image over the coating layer and part of a third image in part of a second area of the print medium adjacent to the first area using a third set of nozzles from the first printhead, wherein at least part of the active zones of the first, second and third sets of nozzles in the first, second and third passes respectively overlap with each other relative to the position of the sets of nozzles on the print medium.

12. A printing apparatus, comprising:

a first printhead including a first set of nozzles for printing in at least two first passes a first image in a first area of a print medium;

a second printhead including a second set of nozzles for printing in at least two second passes a coating layer over the first image in the first area of the print medium;

wherein the first printhead includes a third set of nozzles for printing in at least two third passes a second image over the coating layer in the first area of the print medium, wherein the first and third sets of nozzles are arranged to remain inactive in the first area of the print medium during each second pass and wherein the second set of nozzles is arranged to remain inactive in the first area of the print medium during each first and third pass, and at least one inactive pass between the last of the first passes and the first of the second passes or the last of the second passes and first of the third passes.

* * * * *